US007311563B2

(12) United States Patent
Siebens et al.

(10) Patent No.: US 7,311,563 B2
(45) Date of Patent: Dec. 25, 2007

(54) INSULATED WATER-TIGHT CONNECTOR ASSEMBLY INCLUDING A SET SCREW DRIVER AND PLUG

(75) Inventors: Larry N. Siebens, Asbury, NJ (US); Alan Borgstrom, Hackettstown, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/327,669

(22) Filed: Jan. 6, 2006

(65) Prior Publication Data

US 2006/0155280 A1 Jul. 13, 2006

Related U.S. Application Data

(60) Provisional application No. 60/642,399, filed on Jan. 7, 2005.

(51) Int. Cl.
*H01R 11/01* (2006.01)

(52) U.S. Cl. ..... 439/781; 439/587; 439/521; 439/810

(58) Field of Classification Search ..... 439/793, 439/781, 521, 810–814, 587
See application file for complete search history.

(56) References Cited

U.S. PATENT DOCUMENTS

| | | | | |
|---|---|---|---|---|
| 3,350,677 | A | 10/1967 | Daum | |
| 3,710,307 | A * | 1/1973 | Cooper, Jr. | 439/523 |
| 3,884,725 | A | 5/1975 | Schmidt | |
| 4,044,809 | A | 8/1977 | Guerrico Echevarria | |
| 4,382,651 | A | 5/1983 | Klosin et al. | |
| 4,639,175 | A | 1/1987 | Wollar | |
| 4,836,727 | A | 6/1989 | Volkmann | |
| 4,846,721 | A * | 7/1989 | Debruycker et al. | 439/411 |
| 5,346,782 | A | 9/1994 | Julian | |
| 5,412,806 | A * | 5/1995 | Du et al. | 707/2 |
| 5,533,912 | A | 7/1996 | Fillinger et al. | |
| 6,225,000 | B1 | 5/2001 | Pavlik et al. | |
| 6,764,114 | B1 | 7/2004 | Guillon | |
| 6,764,354 | B2 * | 7/2004 | Kaine et al. | 439/793 |
| 6,854,996 | B2 * | 2/2005 | Yaworski et al. | 439/276 |

* cited by examiner

*Primary Examiner*—Truc Nguyen
(74) *Attorney, Agent, or Firm*—Hoffman & Baron, LLP

(57) ABSTRACT

A set screw electrical connector assembly includes an electrical connector and a set screw drive plug. The connector includes at least one set screw portal sized to accommodate a set screw therein. The set screw drive plug is formed of electrically insulative material and is configured to engage and drive the set screw into the connector. The connector assembly may include an insulative housing formed about the connector for providing a water tight seal with a cable terminated to the connector.

3 Claims, 3 Drawing Sheets

INSULATED WATER-TIGHT CONNECTOR ASSEMBLY INCLUDING A SET SCREW DRIVER AND PLUG

CROSS-REFERENCE TO RELATED APPLICATIONS

This application claims priority to U.S. Provisional Application No. 60/642,399, filed Jan. 7, 2005.

FIELD OF THE INVENTION

The present invention is directed to a submersible set screw electrical connector. More particularly, the present invention relates to a connector employing an insulated and water-tight set-screw driver.

BACKGROUND OF THE INVENTION

Set screw electrical connectors are commonly used to connect or splice distribution cabling to a bus bar. Such connectors generally include a rectangular aluminum or conductive alloy body having a series of openings therein sized to accommodate a transformer stud, prepared cabling and the associated set screws securing the stripped conductors or the cables to the connector. These connectors are often found in locations that are exposed to moisture or are underground. Thus, the connector should provide for water tight connection.

U.S. Pat. No. 5,533,912 discloses a typical design for a set screw electrical connector that prevents water from entering therein. This design encapsulates the connector body with somewhat flexible water-impervious material. The encapsulation includes a series of hollow sleeves which project from the connector body. Certain of the sleeves are designed to accept the cabling therein while others are sized to accommodate the metal set screw. Once the set screw is tightened against the stripped wire conductor, a removable plug or cap is then inserted into this sleeve to seal the opening. A drawback of this typical design is the likelihood that one or more plugs will be lost or not inserted and thus the entire connector will be compromised. Another drawback is that when the user tightens the set screw, there is the risk of electrical shock hazard because the tool employed by the user is usually metal and such a tool will readily conduct electricity directly to the user or to any object coming into contact with the tool during installation if the cable is energized.

U.S. Pat. No. 6,764,354 discloses a variation of the above in that it incorporates a wholly plastic set screw having a threaded lower body portion, a round intermediate body portion and a hex head. The lower body portion is threaded into the connector to secure the cabling in place while the round intermediate body portion forms a seal with the encapsulating material. Obviously, one drawback to this design is the great difference in strength between the metal threads of the connector and the plastic threads of the set screw. Stripping of the plastic threads is likely and thus inadequate compression of the bare conductor will result. This can cause arcing within the connector that will lead to failure. Also, by eliminating the metal set screw, there is less electrical contact between the bare conductor and the electrical connector.

SUMMARY OF THE INVENTION

It is therefore an object of the present invention to provide a set screw electrical connector which incorporates a metal set screw while simultaneously electrically insulating the user (and anything else in contact with the user's tool) from this set screw during insertion and rotation.

Another object of the present invention is to provide an electrical connector with a metal set screw so that greater electrical contact between the connector and the bare conductor is possible.

A further object of the present invention is to eliminate the need for separate plugs or caps to seal the set screw openings thereby eliminating the chance that they will be lost or damaged which would render the connector unsuitable for wet locations.

A further object of the present invention is to provide an electrical connector wherein once the set screw is properly tensioned, no further operation is needed to also make the connector watertight.

The present invention provides a set screw electrical connector assembly including an electrical connector housing having at least one set screw portal which is sized to accept the set screw therein. A set screw drive plug is formed of electrically insulated material and is configured to engage and drive the set screw into the connector.

In a preferred embodiment of the present invention, the set screw is formed of metal and the electrical connector includes a waterproof sleeve which encircles the set screw portal and extends outwardly away from the connector. The set screw drive plug forms a seal with the waterproof sleeve.

In a method aspect of the present invention, a method of sealing a set screw within a set screw connector is provided. The method includes partially threading a set screw within a set screw portal of the set screw connector and thereafter fully driving the set screw into the set screw connector via a set screw drive plug which is electrically insulated.

DETAILED DESCRIPTION OF THE PREFERRED EMBODIMENT

Figure 1:
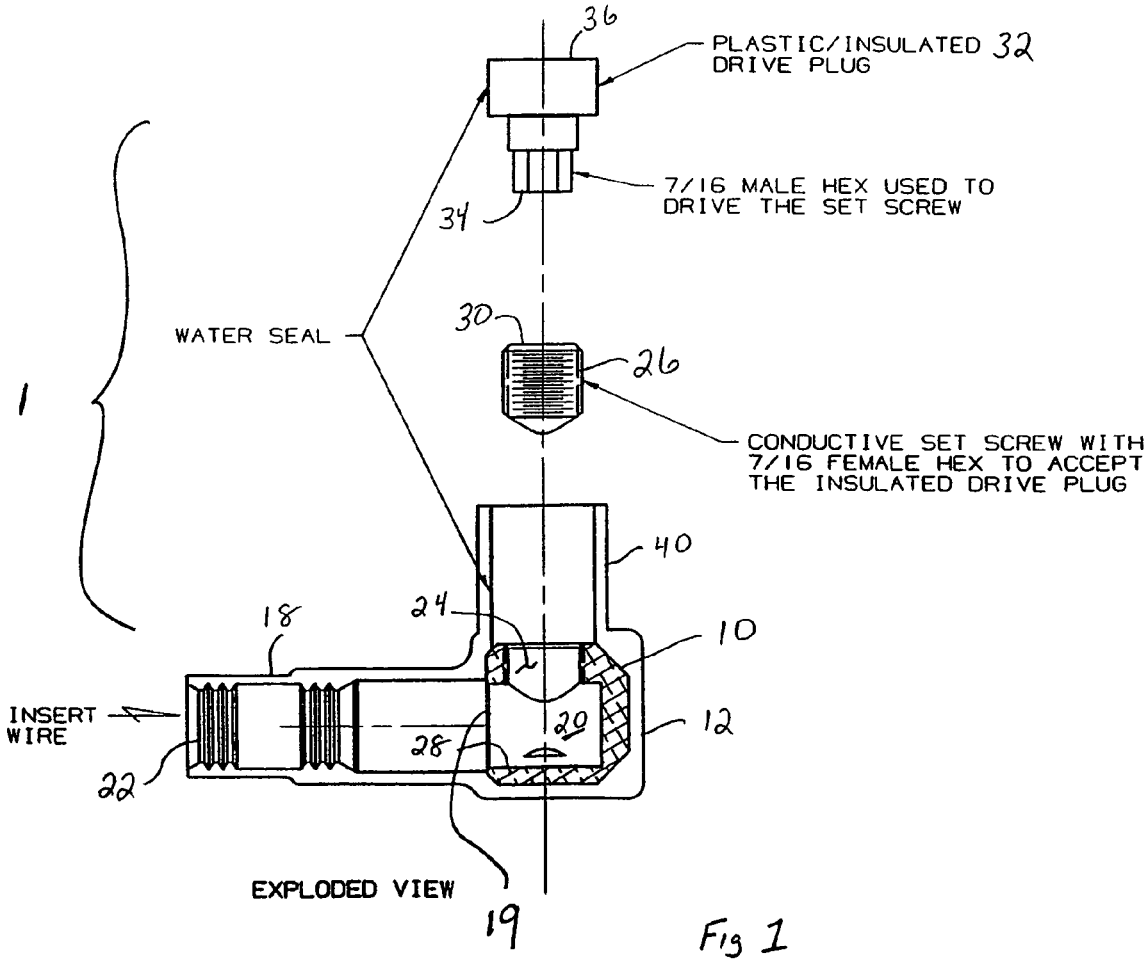
FIG. 1 is an exploded plan view, partially in section, of the connector assembly of the present invention in its unassembled state.
Figure 2:
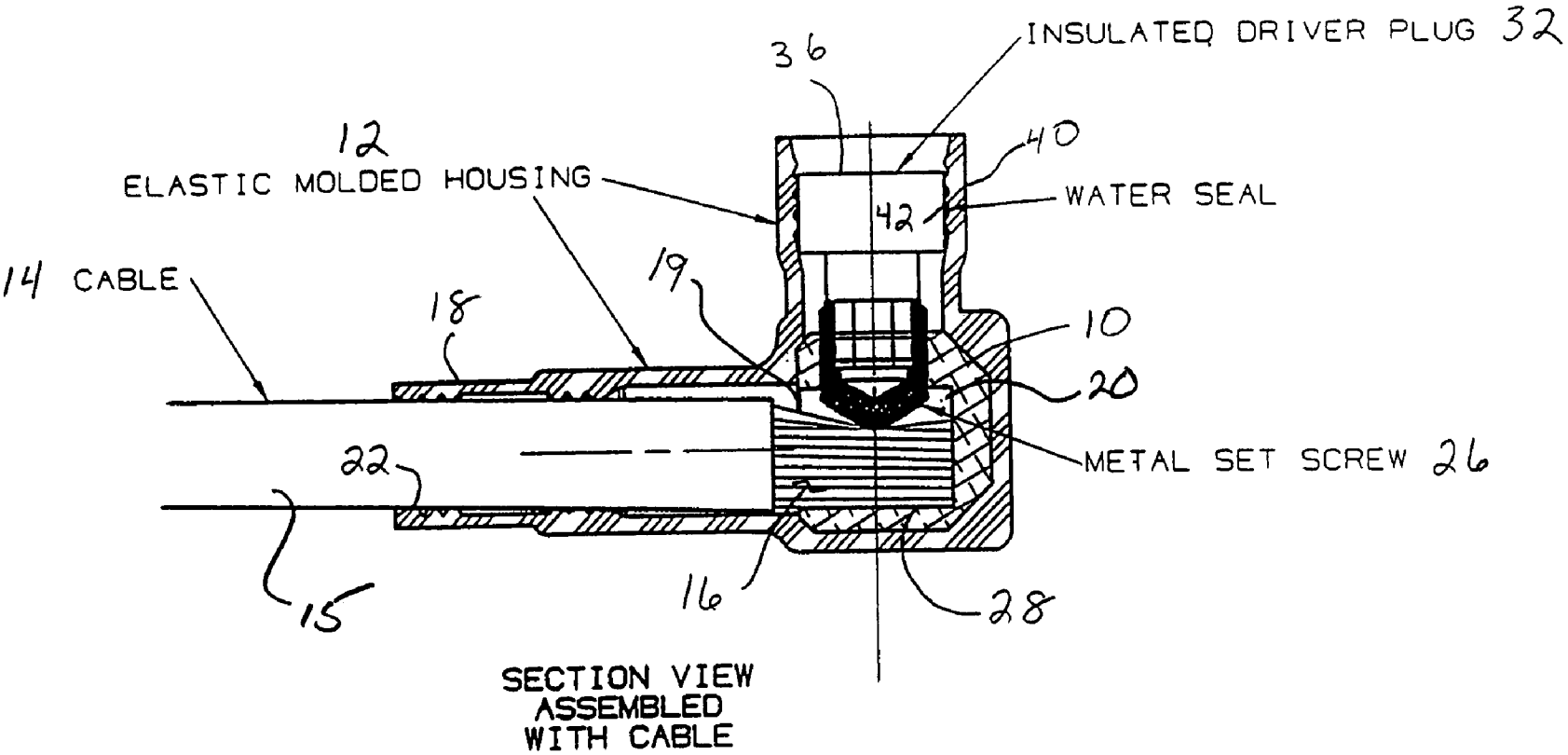
FIG. 2 is a plan view, partially in section, of the connector assembly of FIG. 1.
Figure 5:
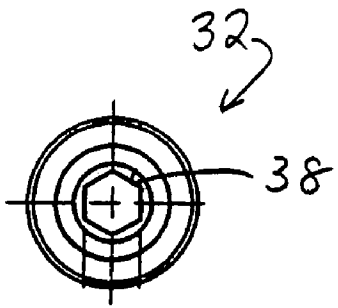
FIGS. 3-5, are respectively, top, side, and bottom views of the set screw driver used in the connector assembly of FIG. 1.
Figure 4:
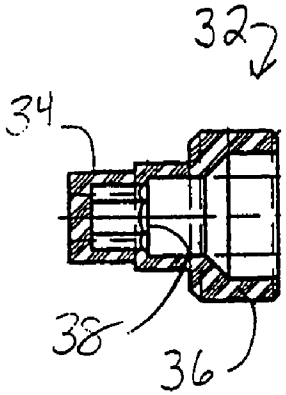
Figure 3:
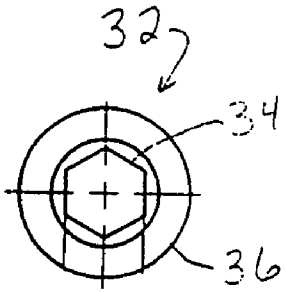

An electrical connector assembly 1 of the present invention is shown. Referring to FIGS. 1 and 2, electrical connector 10 is shown encased within waterproof housing 12. Both connector 10 and housing 12 are of typical material and construction. Connector 10 may be an electrically conductive single bar or may be formed of multiple parallel (and electrically inter-connected) conductive bars for even more connection options. Housing 12 is an electrically insulative plastic member which may be applied about connector 10 is via molding. However, other methods of application are also suitable. As shown in FIGS. 1 and 2, the housing 12 covers the connector 10 and additionally forms extending sleeves 18 and 40 which will be described in further detail hereinbelow.

During assembly of connector 10, a cable 14 is prepared by stripping or baring an end portion of the insulation 15 to expose conductor 16. This prepared cable 14 is then inserted into a cable sleeve 18 formed by housing 12 and through cable aperture 19 until bare conductor 16 is fully within connector area 20. In this embodiment, to prevent water from likewise entering, sleeve 18 is shown as being configured with one or more internal ribs 22 that engage and seal around the outside of cable insulation 15. Such ribs 22 are optional as other means of preventing water entry are also feasible. Depending upon the degree to which these ribs 22 extend inwardly within sleeve 18, different sizes of cable 14 can be accommodated within a single connector 10.

Set screw portal 24 of connector 10 also opens into connector area 20 with this portal 24 being threaded so as to accommodate like-threaded set screw 26. Set screw 26 is preferably metal so that it can establish electrical contact with bare conductor 16. Set screw 26 also presses bare conductor 16 against opposite wall 28 of connector 10 for enhanced electrical connection.

Set screw 26 is of typical construction having a female hex drive slot 30 so that a typical hex tool can be used to tighten set screw 26 against bare conductor 16 within connector 10. Of course, other configurations of set screw 26/drive slot 30 may also be employed. The hex configuration is shown herein as currently the industry typically employs hex drive slots.

While the drawings only show one cable aperture 19 and one set screw portal 24 in connector 10, in practice there would be multiple such openings spaced along all or a portion of the length of connector 10. Similarly, insulative housing 12 may be formed to provide extending sleeves for each connector aperture and portal so that a multitude of cable connections can be made using a single connector assembly 1.

The present invention employs an insulated drive plug 32 to drive set screw 26. Drive plug 32 is typically made of plastic material, but any other electrically insulating material such as rubber, for example, so long as it is stiff or hard enough to rotate set screw 26 under pressure without significant deformation. Plug 32 may also be made of multiple materials if so desired with one material being used for hex drive 34 while another, for example, is employed in head region 36. The use of an insulative plug 32 is advantageous in that there is no electrically conductive path between bare conductor 16 and the tool employed by the user. Thus, even in the situation where a metal set screw 26 is employed within connector 10, electrical isolation to the user is provided.

Drive plug 32 can be a separate component from set screw 26 or the two may be permanently attached or secured together such as by an adhesive. Alternatively, it is also possible to form or mold drive plug 32 to or with set screw 26.

Drive plug 32 would also typically incorporate female hex opening 38 therein but other configurations are also likely. For example, drive plug 32 and more particularly head region 36 could be configured with a male driver such as a hex nut. The user would simply use a tool to engage drive plug 32 so as to rotate it and thus push or bias set screw 26 against bare conductor 16 within connector 10.

To make connector 10 watertight, housing 12 would further be configured with set screw sleeve 40. This set screw sleeve 40 would typically extend from connector 10 and surround set screw portal 24. As with cable sleeve 18, the interior of set screw sleeve 40 could also be configured with one or more optional ribs 42 that project slightly inwardly. Optional ribs 42 would be located so as to engage head region 36 of drive plug 32. In this fashion, by threading drive plug 32 into connector 10, associated head region 36 would engage ribs 42 to thereby form a seal and prevent any moisture from also entering area 20 via this route. It should further be noted that a seal could also be formed directly between the smooth side walls of both head region 36 and the interior of set screw sleeve 40.

In operation, a user would insert cable 14 into opening 19 of connector 10 through sleeve 18 in the normal fashion. The bare conductor 16 would thereby reside in connector area 20. Drive plug 32, which in most cases would already be partially inserted within set screw sleeve 40 (i.e. coming from the manufacturer that way), would then be rotated by the user who would most likely employ a standard hex wrench. Under this arrangement, hex drive 34 of drive plug 32 would already be in full or partial engagement with hex drive slot 30 of set screw 26. Continued rotation by the user of the tool will further cause drive plug 32 to engage bare bare conductor 16 and compress it against opposite wall 28 inside connector area 20 of connector 10. This places the conductor 16 in secure mechanical and electrical engagement with connector 10. Due to the construction of drive plug 32, there is no electrically conductive path between the user and bare conductor 16 even if using a metal set screw 26 and a metal tool. Furthermore, upon rotating drive plug 32 within set screw sleeve 40, head region 36 would engage ribs 42 so as to immediately form a seal between the two thereby preventing moisture from entering connector 10. Also, there is no need to remove drive plug 32 from connector 10 to further tighten or remove set screw 26 as would be the case if connector 10 were sealed by removable caps or plugs or the like.

While select preferred embodiments of this invention have been illustrated, many modifications may occur to those skilled in the art and therefore it is to be understood that these modifications are incorporated within these embodiments as fully as if they were fully illustrated and described herein.

What is claimed is:

1. A method of sealing a metal set screw within a set screw electrical connector comprising the steps of:

providing an electrical connector having a waterproof sleeve encircling a set screw portal extending outwardly from said connector;

partially threading an electrically conductive set screw within said set screw portal;

positioning an electrically insulative set screw drive plug in said portal;

driving said set screw drive plug into said set screw to drive said set screw into said connector; and forming a seal between said set screw drive plug and said sleeve as said set screw drive plug drives said set screw into said electrical connector.

2. The method of sealing a set screw within a set screw electrical connector as set forth in claim 1 further comprising the step of:

forming said waterproof sleeve with at least one internal raised rib configured for engagement with said set screw drive plug.

3. The method of sealing a set screw within a set screw electrical connector as set forth in claim 2 further comprising the step of:

configuring said set screw drive plug with a set screw drive portion and an enlarged head portion, said enlarged head portion and said internal raised rib forming a moisture seal therebetween.

* * * * *